US007918699B2

(12) United States Patent
Malloy

(10) Patent No.: US 7,918,699 B2
(45) Date of Patent: Apr. 5, 2011

(54) CONNECTOR FOR A LEG ROPE

(75) Inventor: John Leo Malloy, Dunsborough (AU)

(73) Assignee: Great Waves Pty. Ltd., Dunsborough, Western Australia ( * ) Notice: Subject to any disclaimer, the term of this patent is extended or adjusted under 35 U.S.C. 154(b) by 0 days.

(21) Appl. No.: 11/899,588

(22) Filed: Sep. 6, 2007

(65) Prior Publication Data

US 2008/0207069 A1 Aug. 28, 2008

(30) Foreign Application Priority Data

Feb. 23, 2007 (AU) ..... 2007900934

(51) Int. Cl.
*B63B 1/00* (2006.01)
*B63B 35/00* (2006.01)

(52) U.S. Cl. ..... 441/75

(58) Field of Classification Search ..... 441/65, 441/74, 75
See application file for complete search history.

(56) References Cited

U.S. PATENT DOCUMENTS 4,610,634 A * 9/1986 Kimura ..... 441/75
7,204,734 B2 * 4/2007 Kawasaki ..... 441/75

* cited by examiner

*Primary Examiner* — Daniel V Venne
(74) *Attorney, Agent, or Firm* — Bachman & LaPointe, P.C.

(57) ABSTRACT

A connector arranged to provide an interconnection between a cord (10) and a fixed element, wherein the cord (10) has a capacity for resilient longitudinal extension, the connector (12) comprising a first portion (22) arranged to be fixed to the fixed element and a second, elongate portion (24) which is resiliently longitudinally extendable and arranged to be fixed to an end (20) of the cord. The invention relates particularly to leg ropes for surfers and connection thereof to surf boards.

6 Claims, 4 Drawing Sheets

CONNECTOR FOR A LEG ROPE

CROSS REFERENCE TO RELATED APPLICATION

The present application is based on and claims priority to Australian Patent Application 2007900934 filed on Feb. 23, 2007.

BACKGROUND OF THE INVENTION

The present invention relates to a connection and in particular a connection which can be utilised for interconnecting a cord to a base.

A particular application of the present invention relates to leg ropes which are utilised by surfers to provide a connection between themselves and their surf board in order that they retain some connection to the surf board in the event of being physically separated from the surfboard. It is a characteristic of such leg ropes that the cord has some capacity for resilient longitudinal extension. However, the connections at the ends of the cord must rigidly interconnect the ends of the cord to the ankle of the surfer and to the surfboard. It has been found in the past that the cords often break at the junction between the ends of the connector and the cord of the leg rope.

BRIEF SUMMARY OF THE INVENTION

In accordance with one aspect of the present invention there is provided an interconnection between a cord and a fixed element, wherein the cord has a capacity for resilient longitudinal extension and the connector comprises a first portion arranged to be fixed to the fixed element and an elongate portion which is resiliently longitudinally extendable and is arranged to be fixed to an end of the cord and be received over an end portion of the cord proximate to the end.

According to a preferred feature of the invention the elongate portion of the connector has a capacity of resilient longitudinal extension such that when the end portion of the cord is caused to extend resiliently the elongate portion of the connector resiliently extends with the end portion.

In one characterization, a surfer's leg rope may be arranged to be connected to a mounting base. A cord is longitudinally resiliently extendible and has an end portion. A connector has an elongate portion which is longitudinally resiliently extendible and is received over and bonded to the end portion of the cord, such that when the end portion of the cord is longitudinally resiliently extended, the elongate portion of the connector extends resiliently with the end portion. The elongate portion has an outer-most end, the outer-most end being formed with a plurality of alternating projections and recesses to provide an extended shoulder between the cord and the connector so as to facilitate the cord to stretch.

In another characterization, a leg rope assembly comprises a mounting base (14); a connector (12); a swivel connector (16) coupling the mounting base to the connector; and a resiliently extendable cord (10) having an end portion (20) received by the connector. An end of the connector forms means for allowing further stretch of the cord so as to reduce breaking of the cord at the end of the connector.

In another characterization, a water sports leash assembly comprises a mounting base and a cord having an outer end arranged to be connected to the mounting base. The cord is substantially circular in cross-section and has a circumference. The mounting base has a connector fixed thereto. The connector includes a connector portion which is molded over the outer end of the cord. The connector portion has an outer end defining a shoulder. The shoulder defines the edge of the bond between the connector and the cord. The shoulder is shaped such that the length of the shoulder is greater than the circumference of the cord.

BRIEF DESCRIPTION OF THE DRAWINGS

The present invention will now be described, by way of example, with reference to the accompanying drawings, in which.

DETAILED DESCRIPTION OF THE INVENTION

Figure 4:
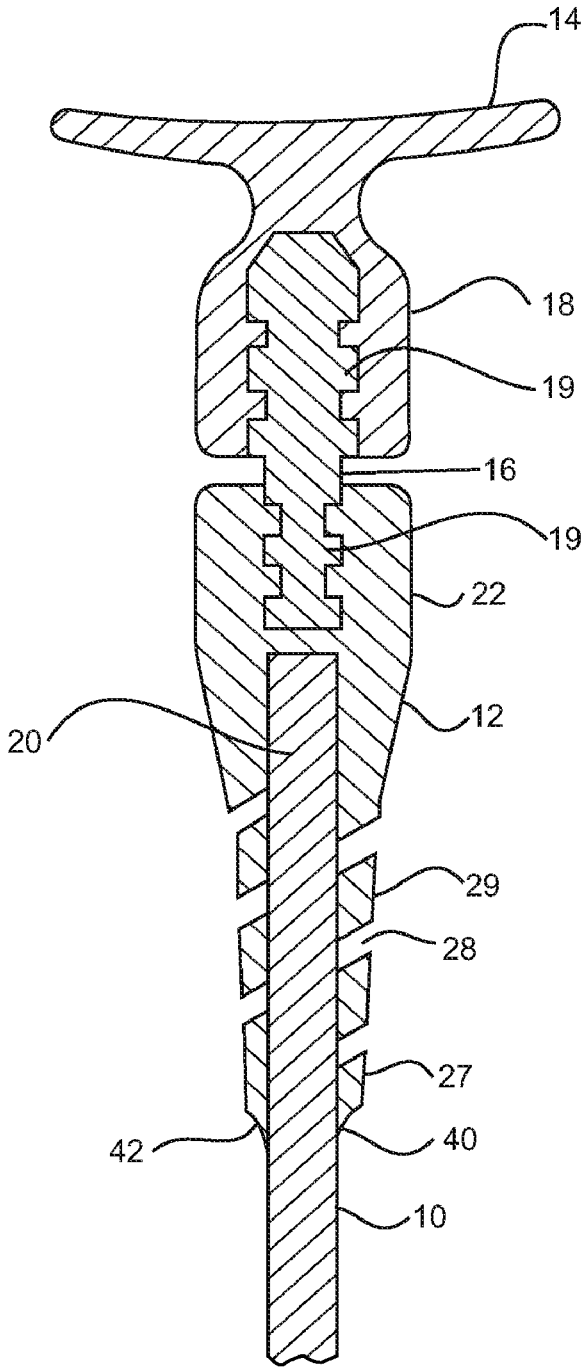
FIG. 4 is a section on the line 4-4 in FIG. 3.
Figure 5:
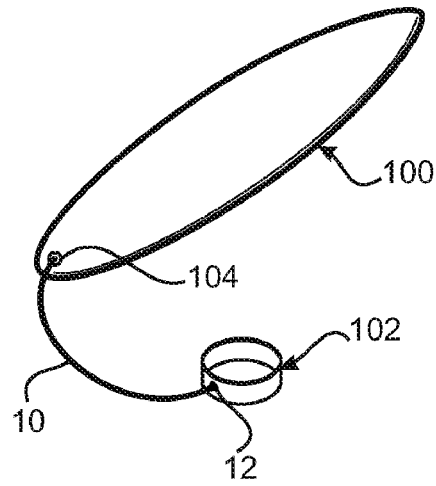
FIG. 5 is a view of a surfboard with a leash assembly including the connector of FIG. 1.

The embodiment as shown in the accompanying drawings relates to a mounting which is utilised to connect a water sports leg rope or leash assembly to an ankle strap and/or a surfboard mount. As shown in the accompanying drawings the leg rope comprises a cord 10, a connector 12, a mounting base (base) 14 and a swivel connector 16. FIG. 5 schematically shows the surfboard 100, the ankle strap 102, and the mount 104. The cord 10 has capacity to be resiliently extendable. The base 14 is configured such that it can be mounted to an ankle strap or alternatively to the surfboard mount or to a rope tied or connected to such a mount. The swivel connector 16 is fixed to the connector 12 in that the connector 12 is moulded around the swivel 16. The other end of the swivel connector 16 (coupling the base 14 to the connector 12) is rotatably received within a tubular boss 18 formed on the base 14. The swivel connector 16 is provided with a plurality of waisted portions as shown in FIG. 4 such that it is positively retained within both the connector 12 and the boss 18. The connector 12 is formed by an injection moulding process to be received over and around the swivel connector 16 and an end portion 20 as best seen in FIG. 4 of the end of the leg rope and is formed of a suitable resiliently flexible material such as a rubber, polyurethane, plastics or other resilient material.

The connector comprises a first portion 22 and a second elongate portion 24 which is received over the end portion 20 of the cord 10. The elongate portion 24 of the connector 12 is formed with opposed fillets 26 and 27 at an outermost end thereof forming a wave of alternating projections 26 and 27 and recesses 30.

Figure 1:
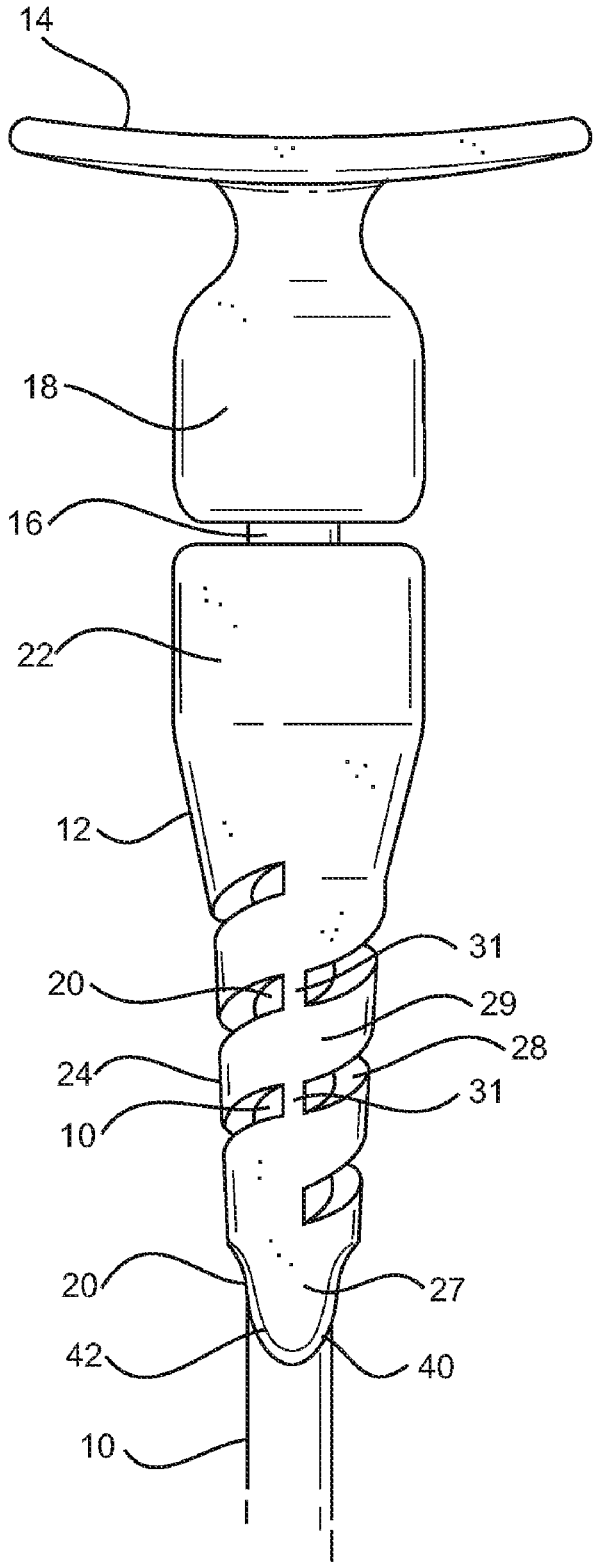
FIG. 1 is a front elevation of a connector in accordance with the present invention.
Figure 2:
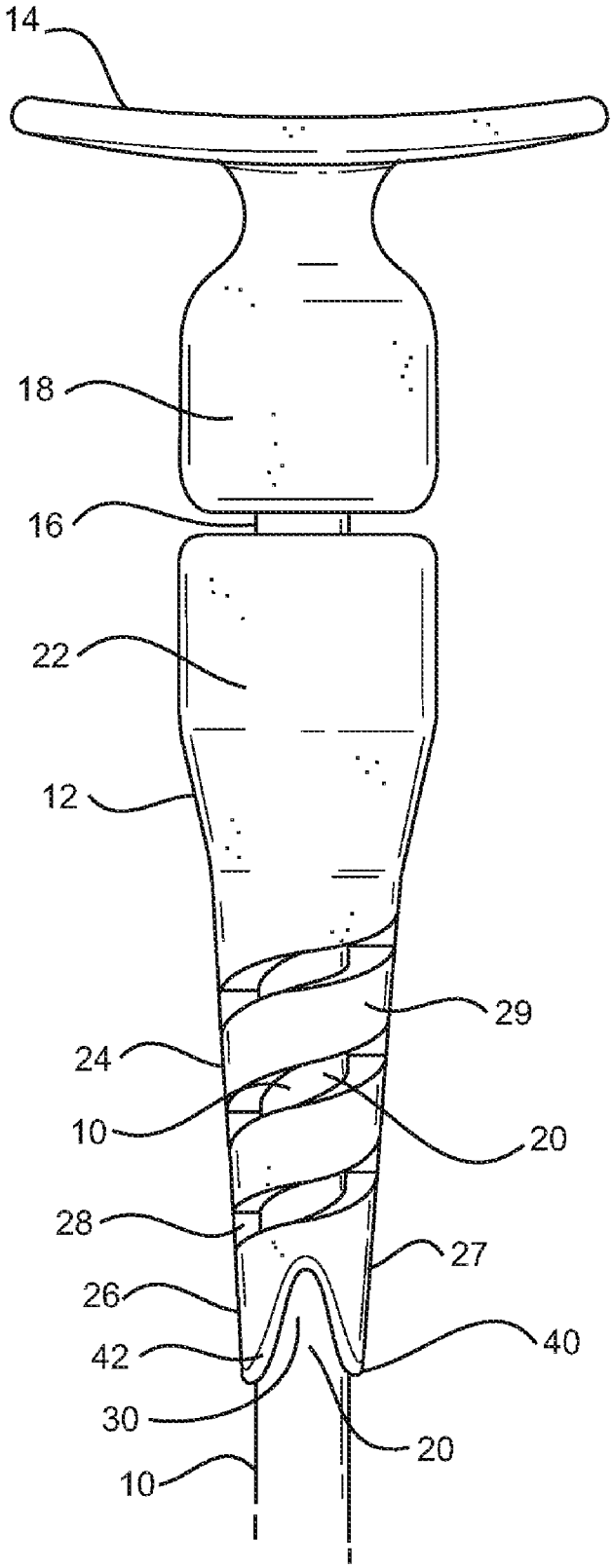
FIG. 2 is a side elevation of the connection of FIG. 1.
Figure 3:
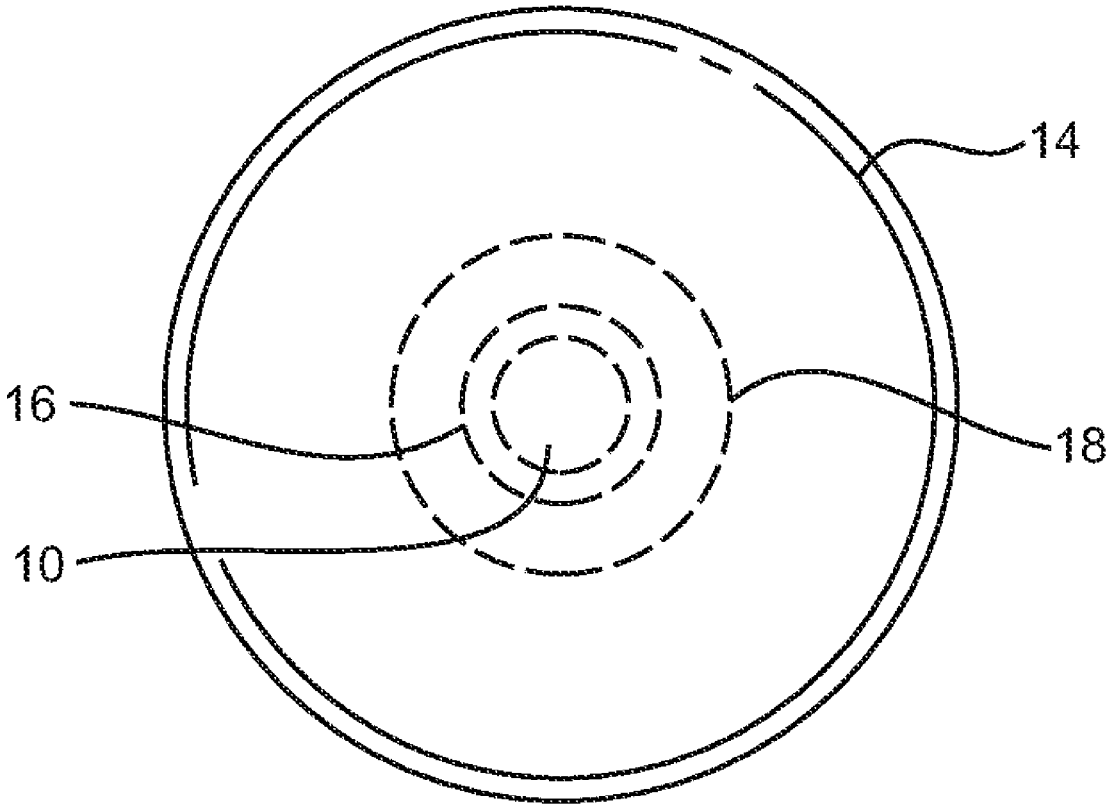
FIG. 3 is a plan view of the connector of FIGS. 1 and 2.

Further, the second elongate portion 24 is formed with partial helix/diagonal substantially parallel alternating ribs and slots 29. The partial helix/diagonal substantially parallel ribs and slots 29 have a part line 31 extending therethrough as can be seen in FIG. 1. This is to enable the connector 12 to be moulded.

The opposed fillets 27 afford a longer shoulder (extended shoulder) between the cord 10 and the connector 12 which allows (facilitates) the cord 10 to stretch further to reduce breaking of the cord at the end of the connector.

The second elongate portion 24 of the connector 12 is bonded to the cord 10 throughout the length of the elongate portion 24 of the connector 12.

The formation of the elongate portion 24 with the partial helix/diagonal substantially parallel alternating ribs and slots 29 between the first portion 22 and the fillets 27 enhances resilient longitudinal extension of the second elongate portion 24 of the connector 12 with longitudinal extension of the cord 10 when the cord 10 is under load and extending. This reduces the likelihood of a loss of integrity of the interconnection between the cord 10 and the connector 12 or the exertion of excessive stress on the interconnection between the cord 10 and the connector 12.

Modifications and variations as would be apparent to a skilled addressee are deemed to be within the scope of the present invention.

The invention claimed is:

1. A surfer's leg rope arranged to be connected to a mounting base, comprising a cord which is longitudinally resiliently extendible and has an end portion, a connector having an elongate portion which is longitudinally resiliently extendible and is received over and bonded to the end portion of the cord, such that when the end portion of the cord is longitudinally resiliently extended, the elongate portion of the connector extends resiliently with the end portion, wherein the elongate portion has an outer-most end, the outer-most end being formed with a plurality of alternating projections and recesses to provide an extended shoulder between the cord and the connector so as to facilitate the cord to stretch.

2. The leg rope of claim 1, wherein the outer-most end of the elongate portion has alternating substantially parallel ribs and slots away from the outer-most end exposing the cord through the slots to facilitate stretching of the cord.

3. The leg rope of claim 2, wherein the ribs and slots have a partial helical or diagonal configuration exposing the cord through the slots to facilitate the cord to stretch.

4. The leg rope of claim 2, wherein the ribs and slots have a partial helical or diagonal configuration and wherein the parallel ribs and slots have a part line extending therethrough to enable the connector to be molded.

5. The leg rope of claim 2, wherein the base and the connector are interconnected by a swivel connector such that the base and the connector are relatively rotatable with respect to each other.

6. The leg rope of claim 1, wherein the base and the connector are interconnected by a swivel connector such that the base and the connector are relatively rotatable, and the swivel connector is rotatably received in a tubular boss formed in the base.

* * * * *